US008811862B2

(12) United States Patent
Nagashima

(10) Patent No.: US 8,811,862 B2
(45) Date of Patent: Aug. 19, 2014

(54) DEVELOPING MECHANISM AND IMAGE FORMING APPARATUS

(71) Applicant: Kyocera Document Solutions Inc., Osaka (JP)

(72) Inventor: Teruhiko Nagashima, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 51 days.

(21) Appl. No.: 13/677,368

(22) Filed: Nov. 15, 2012

(65) Prior Publication Data

US 2013/0136503 A1 May 30, 2013

(30) Foreign Application Priority Data

Nov. 25, 2011 (JP) ..... 2011-258129

(51) Int. Cl.
*G03G 15/08* (2006.01)
*G03G 21/16* (2006.01)

(52) U.S. Cl.
CPC ..... *G03G 15/0837* (2013.01); *G03G 15/0886* (2013.01); *G03G 21/1633* (2013.01)
USPC ..... 399/262; 399/258; 399/119

(58) Field of Classification Search
CPC ..... G03G 15/0121; G03G 15/0822; G03G 15/0834; G03G 15/0872; G03G 15/0868; G03G 15/0891; G03G 15/104
See application file for complete search history.

(56) References Cited

U.S. PATENT DOCUMENTS

| | | | | |
|---|---|---|---|---|
| 5,398,098 | A | 3/1995 | Fukunaga et al. | |
| 5,862,441 | A | 1/1999 | Ohata | |
| 5,933,691 | A * | 8/1999 | Johroku | 399/262 |
| 6,041,212 | A | 3/2000 | Okada | |
| 2006/0193652 | A1 | 8/2006 | Sato | |
| 2007/0065184 | A1 | 3/2007 | Sato | |
| 2007/0248384 | A1 | 10/2007 | Kawai | |
| 2008/0063427 | A1 * | 3/2008 | Ikado et al. | 399/106 |
| 2008/0170887 | A1 | 7/2008 | Nishimura et al. | |
| 2008/0181673 | A1 | 7/2008 | Kim et al. | |
| 2010/0054819 | A1 | 3/2010 | Sato | |
| 2010/0178080 | A1 | 7/2010 | Huang | |

FOREIGN PATENT DOCUMENTS

| | | |
|---|---|---|
| JP | 62-200386 | 9/1987 |
| JP | 62-2000386 | 9/1987 |
| JP | 6-19299 | 1/1994 |

(Continued)

*Primary Examiner* — Clayton E Laballe
*Assistant Examiner* — Victor Verbitsky
(74) *Attorney, Agent, or Firm* — Gerald E Hespos; Michael J. Porco; Matthew T. Hespos

(57) ABSTRACT

The present application discloses a developing mechanism including a developing device for developing electrostatic latent images and a container containing developer. The developing device includes a carrier carrying and supplying the developer to the electrostatic latent images; a first housing having a feed port through which the developer is fed; a first conveyance member conveying the developer along a first direction away from the feed port; and a first shutter mechanism selectively opening and closing the feed port. The container includes a second housing having a supply port from which the developer is supplied through the feed port to the developing device; a second shutter mechanism selectively opening and closing the supply port; and a second conveyance member conveying the developer along a second direction across the first direction for developer discharge through the supply port. The feed port is opened earlier than the supply port is opened.

11 Claims, 20 Drawing Sheets

(56) References Cited

FOREIGN PATENT DOCUMENTS

| | | |
|---|---|---|
| JP | 6-208299 | 7/1994 |
| JP | 7-49610 | 2/1995 |
| JP | 2000-56550 | 2/2000 |
| JP | 2000-315007 | 11/2000 |
| JP | 2001-154473 | 6/2001 |
| JP | 2004-184746 | 7/2004 |
| JP | 2007-127937 | 5/2007 |
| JP | 2009-210966 | 9/2009 |

* cited by examiner

DEVELOPING MECHANISM AND IMAGE FORMING APPARATUS

The present application claims priority to Japanese Patent Application No. 2011-258129 filed to Japanese Patent Office on Nov. 25, 2011, the contents of which are hereby incorporated by reference.

BACKGROUND

The present disclosure relates to a developing mechanism for an electrostatic latent image and an image forming apparatus having the developing mechanism.

An image forming apparatus such as printers and copiers includes a developing mechanism configured to develop electrostatic latent images. The developing mechanism typically includes a container configured to store developer and a developing device which receives the developer from the container. As a result of developer delivery from the developing device to an electrostatic latent image, the electrostatic latent image is developed to form a toner image. The toner image is then transferred onto on a sheet.

In many cases, a developing device includes a housing elongated in a perpendicular direction to a conveyance direction of sheets. The housing is provided with a feed port through which developer is fed from a container. The developing device further includes a conveyance member situated in the housing. The conveyance member extending in the perpendicular direction to the sheet conveyance direction like the housing conveys the developer away from the feed port after the developer is supplied through the feed port, in order to prevent the developer from depositing around the feed port. Consequently, the developer is smoothly supplied through the feed port.

A container is typically inserted substantially in parallel to the developing device. During the parallel displacement of the container with respect to the developing device, a shutter mechanism is activated in order to control communication between the container and the developing device. As a result of the operation of the shutter mechanism, the container is communicated with the developing device when the container is attached in position to the developing device.

If a discharge outlet, from which sheets are discharged after toner image formation on the sheets, faces to a user, the user may easily and visually confirm the discharge of sheets after the image formation. Therefore, the arrangement of the discharge outlet facing the user may be advantageous in terms of handling the discharged sheets.

A container may be replaced by a user. Therefore, it may be preferable that the container is situated near the user.

If the conventional parallel arrangement between a container and a developing device and the layout of the discharge outlet facing a user are employed, an image forming portion (e.g., an image carrier onto which an electrostatic latent image is formed) has to be situated near the user although the image forming portion occupies a large space in an internal space of an image forming apparatus, which results in large restrictions on structures and functions of the image forming apparatus.

Unless a container is in parallel to the developing device, an image forming apparatus may be designed under few structural and functional restrictions so that a user easily replaces the container and easily handles discharged sheets.

If the container intersects with the developing device, the image forming apparatus may be more flexibly designed. On the other hand, a shutter mechanism, which is employed in the conventional parallel arrangement, may not appropriately prevent developer leakage from the container.

An object of the present disclosure is to provide a developing mechanism and an image forming apparatus including a shutter mechanism which appropriately prevents developer leakage from a container arranged to intersect with a developing device.

SUMMARY

The developing mechanism according to one aspect of the present disclosure includes a developing device configured to supply the developer to an electrostatic latent image and develop the electrostatic latent image; and a container configured to contain the developer. The developing device includes a carrier configured to carry and supply the developer to the electrostatic latent image; a first housing provided with a feed port through which the developer is fed; a first conveyance member configured to convey the developer along a first direction away from the feed port; and a first shutter mechanism configured to selectively open and close the feed port. The container includes a second housing provided with a supply port from which the developer is supplied through the feed port to the developing device; a second shutter mechanism configured to selectively open and close the supply port; and a second conveyance member configured to convey the developer along a second direction across the first direction and discharge the developer through the supply port. The feed port is opened earlier than the supply port.

The image forming apparatus according to another aspect of the present disclosure includes an image carrier onto which an electrostatic latent image is formed and the aforementioned developing mechanism.

DETAILED DESCRIPTION

An exemplary developing mechanism and an exemplary image forming apparatus are described with reference to the accompanying drawings. Directional terms such as "upper", "lower", "left" and "right" hereinafter are merely used for the purpose of clear explanation and do not by any means limit principles of the developing mechanism and the image forming apparatus.

(Image Forming Apparatus)

Figure 1:
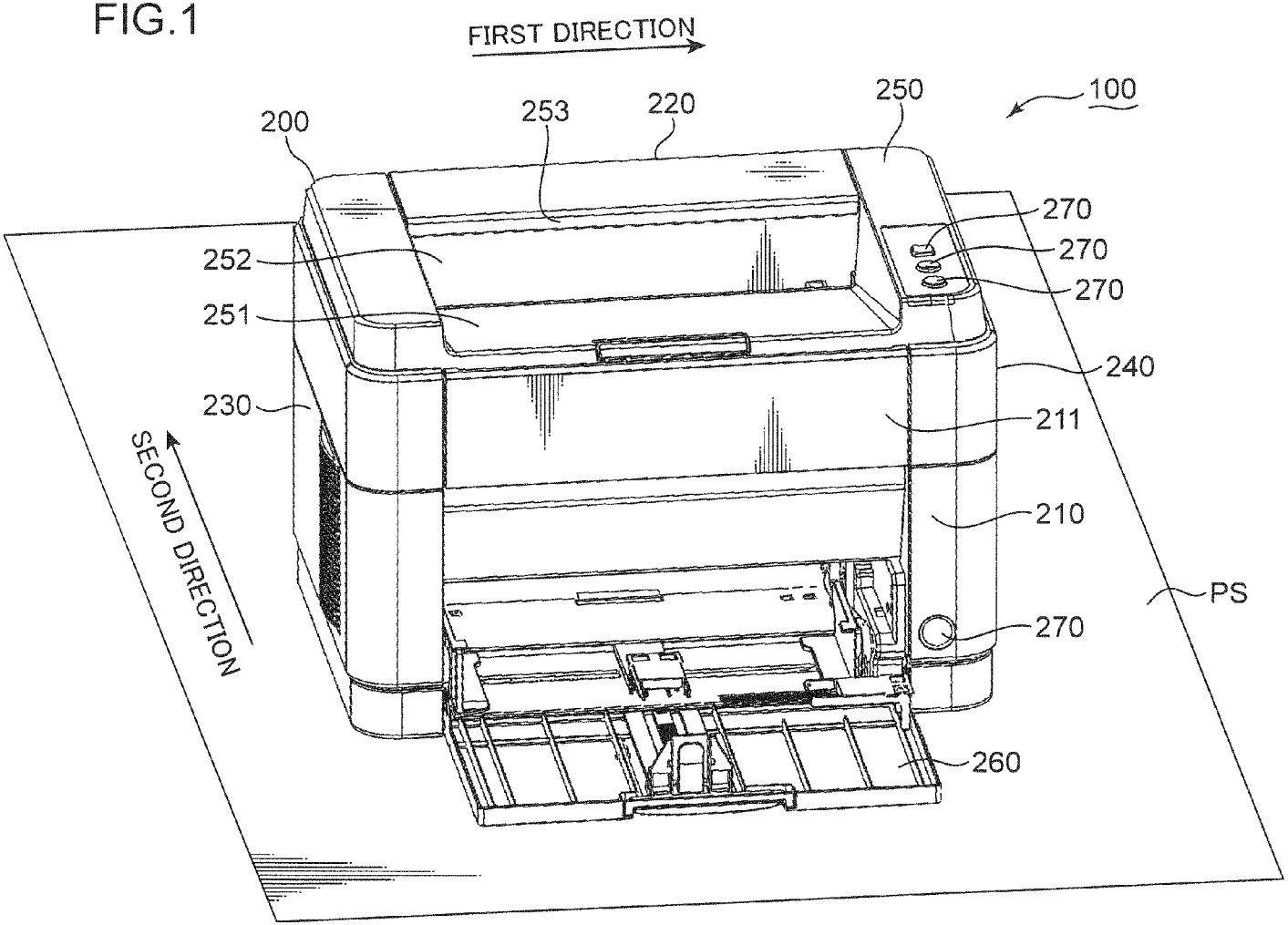
FIG. 1 is a schematic perspective view of a printer exemplified as an image forming apparatus.

FIG. 1 is a schematic perspective view of the printer 100 exemplified as the image forming apparatus. The printer 100 is described with reference to FIG. 1. The image forming apparatus may be copiers and other apparatus which can form images on sheets.

The printer 100 includes a main housing 200 which defines a room for storing various devices configured to form images on sheets (e.g. a photoconductor drum, a developing device or a container). The main housing 200 includes a front wall 210 perpendicular to a surface PS, onto which the printer 100 is placed; a back wall 220 opposite to the front wall 210; a left wall 230 situated between the front and back walls 210, 220; a right wall 240 opposite to the left wall 230; and a top wall 250 surrounded by the upper edges of the front, back, left and right walls 210, 220, 230, 240. In the following description, the direction from the left wall 230 to the right wall 240 is referred to as "first direction". The direction from the front wall 210 to the back wall 220 is referred to as "second direction". The first direction is orthogonal to the second direction. The term "orthogonal" does not only mean an intersection at an angle of exact "90°". An angle of intersection around "90°" is also included in the term "orthogonal" so long as the principle of the present embodiment is realized. The front and back walls 210, 220 are arranged along the first direction (i.e., the front and back walls 210, 220 are arranged substantially in parallel to the first direction). The left and right walls 230, 240 are arranged along the second direction (i.e., the left and right walls 230, 240 are arranged substantially in parallel to the second direction). In the present embodiment, the front wall 210 is exemplified as the first upright wall. The back wall 220 is exemplified as the second upright wall. The left wall 230 is exemplified as the side wall.

The printer 100 further includes a sheet tray 260 onto which sheets are placed or stored. The sheets placed on the sheet tray 260 are sent into the main housing 200 and then subjected to image forming processes. The rotatable sheet tray 260 is attached to the front wall 210. A user may pull the sheet tray 260 forward to place sheets on the sheet tray 260.

The top wall 250 of the main housing 200 includes a slope wall 251 which defines a recess for accumulating sheets after image formation processes and a discharge wall 252 standing from the slope wall 251. The discharge wall 252 is provided with a discharge outlet 253 from which sheets are discharged. The sheets discharged from the discharge outlet 253 are accumulated on the slope wall 251.

The printer 100 includes multiple operation buttons 270 arranged on the front wall 210 and in an area on the top wall 250 near the front wall 210. Thus, a user in front of the front wall 210 may easily operate the printer 100. As a sheet is discharged from the discharge outlet 253 towards the user standing in front of the front wall 210, the user may easily observe the sheet discharge. In addition, as the sheet tray 260 is also provided on the front wall 210 as described above, the user standing in front of the front wall 210 may observe an amount of the sheets on the sheet tray 260. Therefore, when the user faces the front wall 210, the user may easily operate and observe operations of the printer 100.

The front wall 210 includes a cover panel 211 detachable from the main housing 200. A user may detach the cover panel 211, which forms an upper portion of the front wall 210, in order to access various devices situated in the main housing 200.

Figure 2:
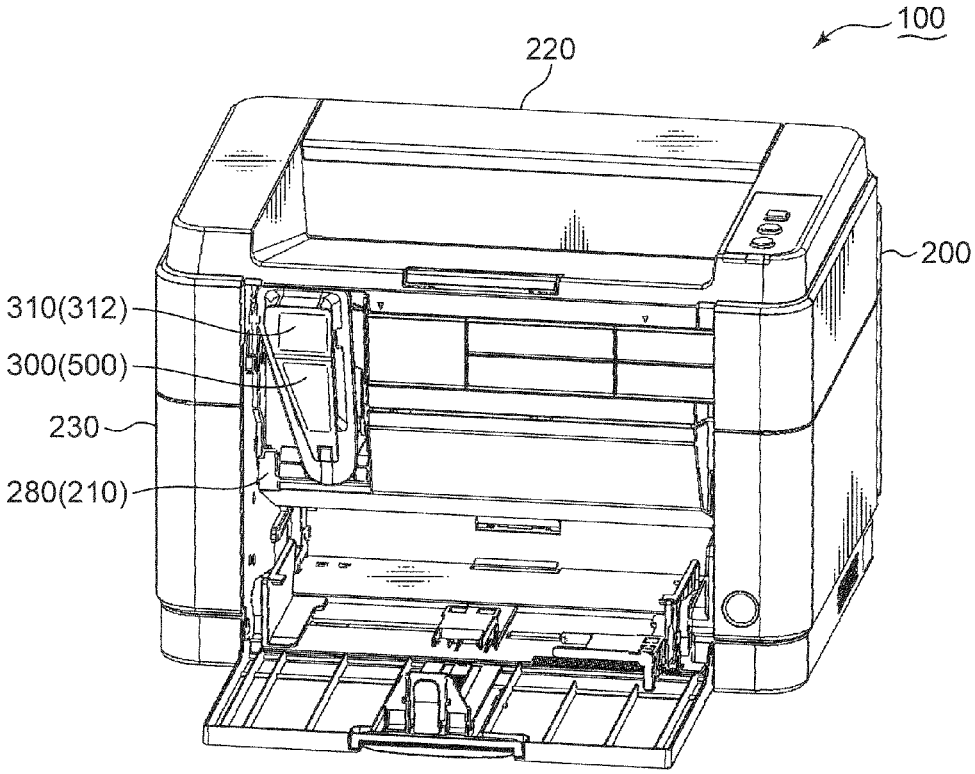
FIG. 2 is a schematic perspective view of the printer from which a cover panel is detached.
Figure 3:
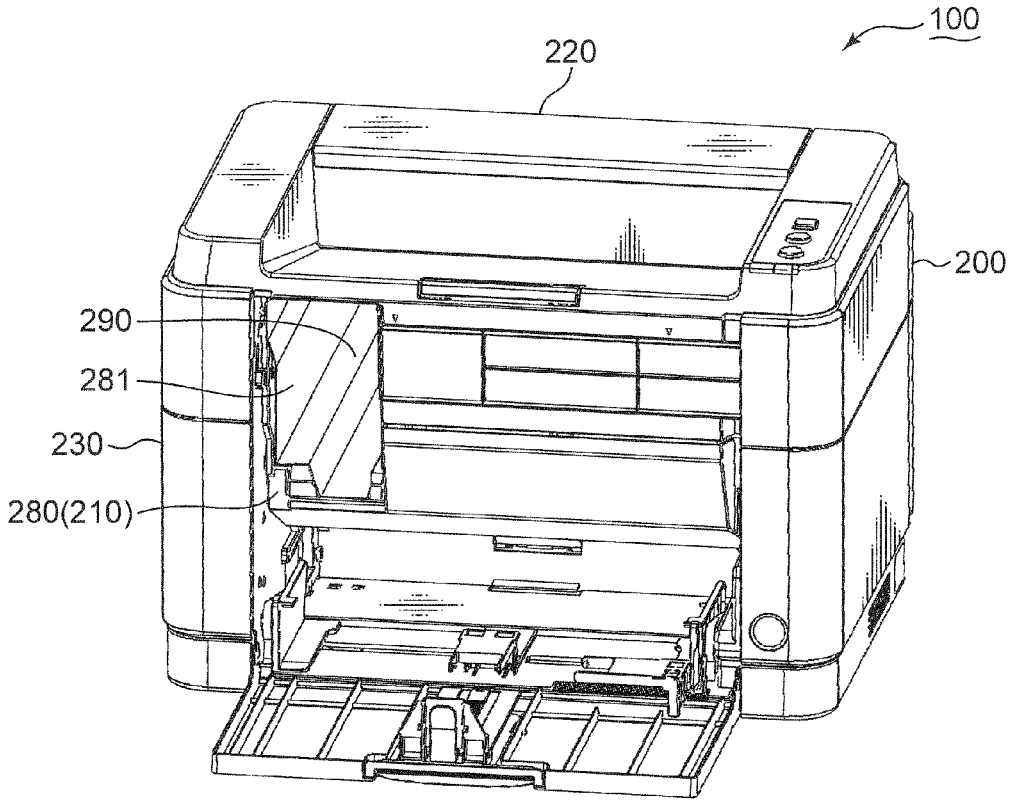
FIG. 3 is a schematic perspective view of the printer from which the cover panel is detached.

FIGS. 2 and 3 are schematic perspective views of the printer 100 from which the cover panel 211 is detached. The printer 100 is further described with reference to FIGS. 1 to 3.

As shown in FIG. 2, the printer 100 further includes a container 300 as a part of a developing mechanism 500 and an inner frame 280 which supports the container 300 and other devices for forming images. The container 300 contains developer. A part of the inner frame 280 nearby the cover panel 211 forms a part of the front wall 210.

A user may detach the cover panel 211 from the main housing 200 to expose the container 300. If the container 300 contains an insufficient amount of the developer, the user may easily pull out the container 300 from the main housing 200.

As shown in FIG. 3, the inner frame 280 is provided with an insertion opening 281 through which the container 300 is inserted into the main housing 200. The user may push the container 300 containing a sufficient amount of developer along the left wall 230 through the insertion opening 281 into a storage room 290 defined by the main housing 200.

Figure 4:
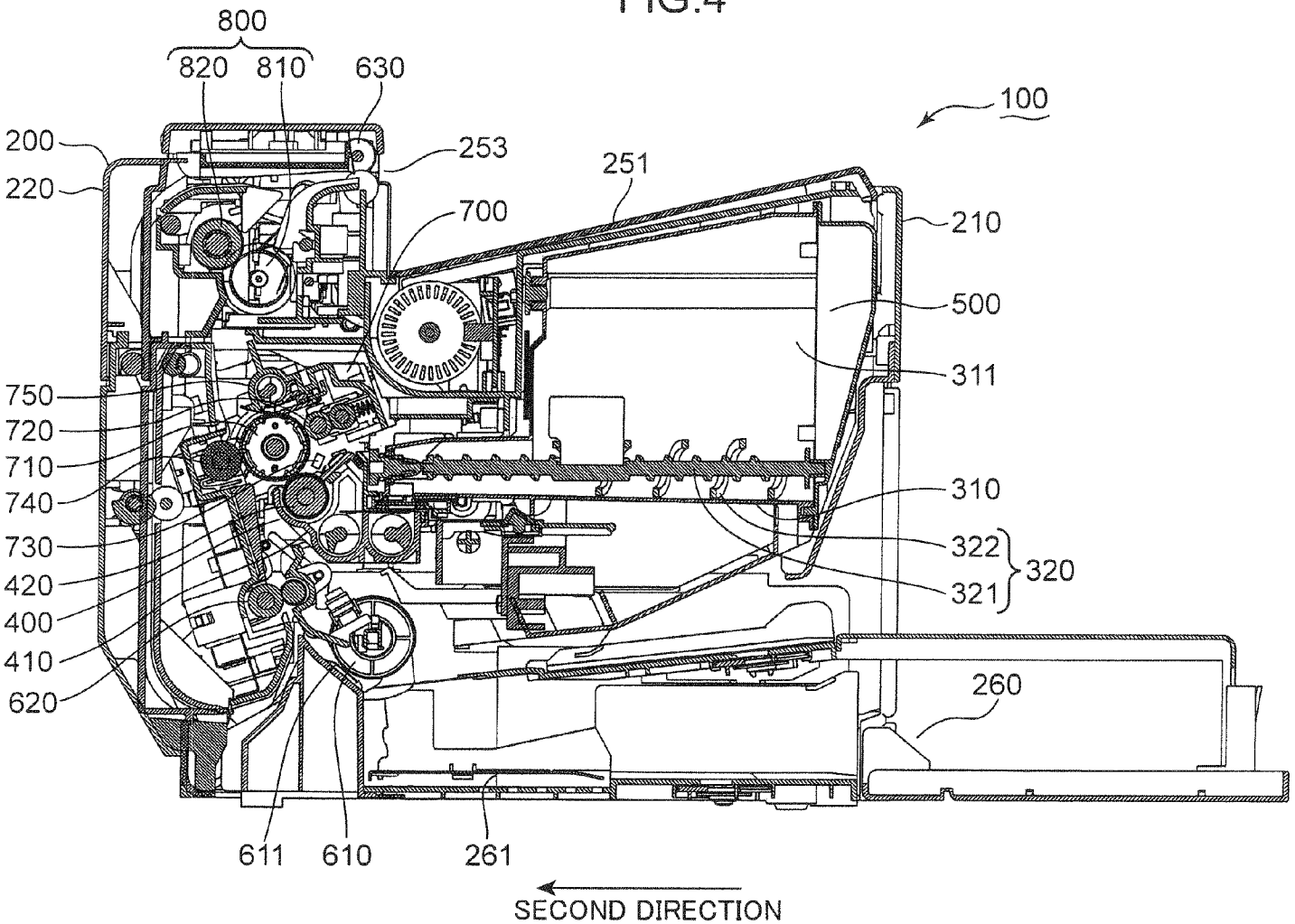
FIG. 4 is a schematic sectional view of the printer shown in FIG. 1.

FIG. 4 is a schematic sectional view of the printer 100. The printer 100 is further described with reference to FIG. 4.

The sheet tray 260 includes a lift plate 261 which lifts the leading edges of sheets. The printer 100 further includes a feed roller 610, which is arranged above the lift plate 261, and a friction plate 611 nearby the feed roller 610. The leading edge of a sheet lifted up by the lift plate 261 comes into contact with the feed roller 610. The feed roller 610 rotates so that the sheet is conveyed downstream. Sheets pass between the friction plate 611 and the feed roller 610 one by one downstream. The sheet tray 260 and the feeding structure configured to feed sheets from the sheet tray 260 do not by any means limit the principle of the present embodiment.

The printer 100 further includes a pair of resist rollers 620 situated after the feed roller 610 and an image forming portion 700 which forms images on sheets. The feed roller 610 sends a sheet to the paired resist rollers 620. The paired resist rollers 620 sends the sheet to the image forming portion 700 in synchronization with image forming processes in the image forming portion 700. Consequently, an image is formed in position on the sheet.

The image forming portion 700 includes a photoconductor drum 710 having a circumferential surface, on which an electrostatic latent image is formed; a charging device 720, which uniformly charges the circumferential surface of the photoconductor drum 710; and an exposure device 730, which irradiates the charged circumferential surface of the photoconductor drum 710 with laser light. When the photoconductor drum 710 rotates, the circumferential surface of the photoconductor drum 710 charged by the charging device 720 moves to an exposure position at which the circumferential surface is subjected to exposure processes by the exposure device 730. The printer 100 is electrically connected to an external apparatus (e.g., a personal computer (not shown)) which outputs image signals. The exposure device 730 irradiates the circumferential surface of the photoconductor drum 710 with laser light in response to the image signals from the external apparatus. Consequently, a coincident electrostatic latent image to an image defined by the image signals is formed on the circumferential surface of the photoconductor drum 710. In the present embodiment, the photoconductor drum 710 is exemplified as the image carrier.

The image forming portion 700 includes the aforementioned developing mechanism 500. The circumferential surface of the photoconductor drum 710 carrying the electrostatic latent image moves to a development position at which the circumferential surface is subjected to development processes by the developing mechanism 500.

In addition to the aforementioned container 300, the developing mechanism 500 includes a developing device 400 which supplies developer to an electrostatic latent image formed on the circumferential surface of the photoconductor drum 710. As a result of developer supply from the developing device 400, the electrostatic latent image is developed (visualized) to form a toner image on the circumferential surface of the photoconductor drum 710. The structure of the developing mechanism 500 is described hereinafter.

The image forming portion 700 further includes a transfer roller 740 which transfers a toner image formed on the circumferential surface of the photoconductor drum 710 to a sheet. The circumferential surface of the photoconductor drum 710 carrying the toner image moves to a transfer position at which the circumferential surface is subjected to transfer processes by the transfer roller 740. The aforementioned paired resist rollers 620 sends a sheet between the photoconductor drum 710 and the transfer roller 740. The transfer roller 740 electrostatically takes off and transfers the toner image from the photoconductor drum 710 onto a sheet surface.

The image forming portion 700 further includes a cleaning device 750 which removes developer from the circumferential surface of the photoconductor drum 710. The circumferential surface of the photoconductor drum 710 after completion of toner image transfer to a sheet moves to a cleaning position at which the circumferential surface is subjected to cleaning processes by the cleaning device 750. The cleaning device 750 removes developer, which is remained on the circumferential surface of the photoconductor drum 710. The circumferential surface of the photoconductor drum 710 then moves to a charging position, at which the circumferential surface is subjected to charging processes by the charging device 720 to start the next image forming process. The aforementioned image forming process, and structures and arrangements of various devices used for the image forming process do not by any means limit the principle of the present embodiment.

The printer 100 further includes a fixing device 800 configured to fix toner images on sheets. The fixing device 800 includes a heating roller 810, which melts toner of the toner image transferred on the sheet, and a pressure roller 820, which presses the toner image onto the heating roller. The photoconductor drum 710 and the transfer roller 740 send a sheet between the heating roller 810 and the pressure roller 820. Toner of the toner image carried with the sheet is melted by the heating roller 810 and then fixed on the sheet. The structure of the fixing device does not by any means limit the principle of the present embodiment.

The printer 100 further includes a pair of discharge rollers 630 which is arranged nearby the discharge outlet 253 formed on the main housing 200. The heating roller 810 and the pressure roller 820 send a sheet to the paired discharge rollers 630. The paired discharge rollers 630 discharge the sheet on the slope wall 251 through the discharge outlet 253.

(Developing Device)

Figure 5:
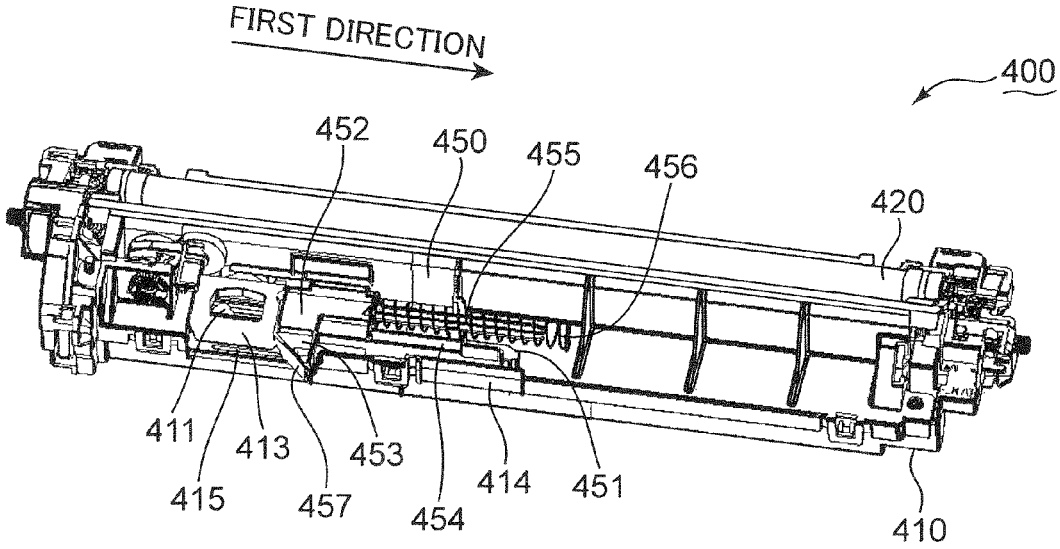
FIG. 5 is a schematic perspective view of a developing device assembled in the printer shown in FIG. 4.

FIG. 5 is a schematic perspective view of the developing device 400. The developing device 400 is described with reference to FIGS. 2, 4 and 5.

The developing device 400 includes a first housing 410 elongated in the first direction (i.e., the width direction of a sheet) and a developing roller 420 supported by the first housing 410. There is a feed port 411 at the left end of the first housing 410.

As shown in FIG. 2, the container 300 is adjacent to the left wall 230. The container 300 inserted along the left wall 230 is connected to the left end of the first housing 410. Developer stored in the container 300 is supplied into the first housing 410 through the feed port 411.

As shown in FIG. 4, the developing roller 420 is adjacent to the photoconductor drum 710. The developing roller 420 carries and supplies developer stored in the first housing 410 to an electrostatic latent image formed on the circumferential surface of the photoconductor drum 710. In the present embodiment, the developing roller 420 is exemplified as the carrier.

Figure 6:
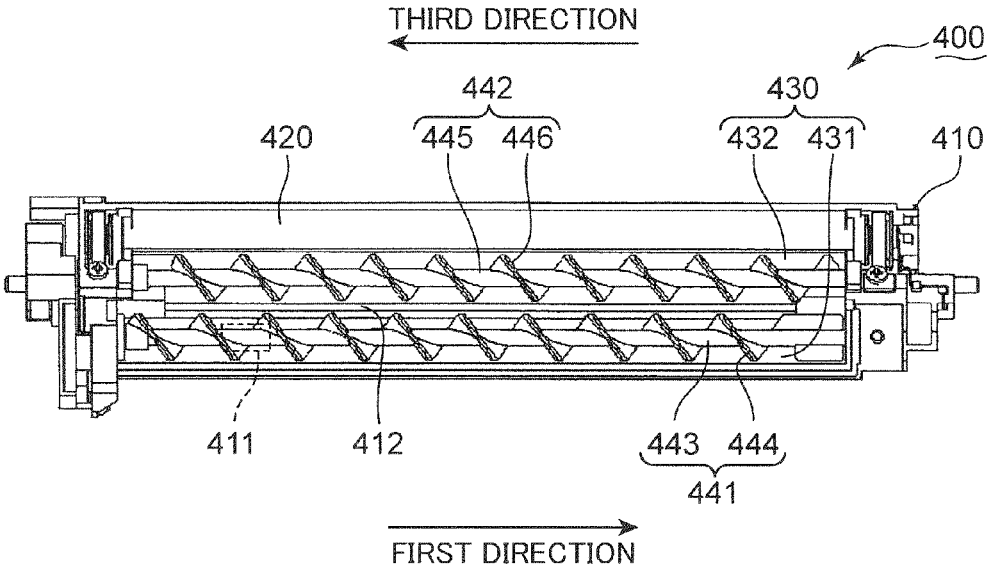
FIG. 6 is a schematic view of an internal structure of the developing device shown in FIG. 5.

FIG. 6 is a schematic view of an internal structure of the developing device 400. The developing device 400 is further described with reference to FIG. 6.

The first housing 410 of the developing device 400 includes a partition wall 412 configured to partition the storage room 430, in which developer is stored, into a first room 431 and a second room 432. In FIG. 6, the aforementioned feed port 411 is shown with the dotted line. The feed port 411 directly communicates with the first room 431. The first room 431 communicates with the second room 432 at the right end of the first housing 410. Developer supplied to the first room 431 through the feed port 411 is flown into the second room 432 at the right end of the first housing 410.

The developing device 400 further includes a first conveyance screw 441 situated in the first room 431 and a second conveyance screw 442 situated in the second room 432. The first conveyance screw 441 includes a shaft 443 extending along the first direction and a screw 444 wound around the shaft 443. The second conveyance screw 442 includes a shaft 445 substantially in parallel to the shaft 443 and a screw 446 wound around the shaft 445.

When the first conveyance screw 441 rotates, developer supplied into the first room 431 is conveyed in the first direction away from the feed port 411. Consequently, the developer reaches the right end of the first housing 410 and is flown into the second room 432. In the present embodiment, the first conveyance screw 441 is exemplified as the first conveyance member.

When the second conveyance screw 442 rotates, the developer flown in the second room 432 is conveyed in a third direction opposite to the first direction. The developer conveyed by the first and second conveyance screws 441, 442 contains toner particles and carrier particles. The first and second conveyance screws 441, 442 stir these particles during the conveyance. Accordingly, the toner particles are charged and electrostatically adhered to the developing roller 420 during the conveyance by the second conveyance screw 442. Therefore, the developing roller 420 uniformly carries the toner particles.

(Developing Mechanism)

Figure 7:
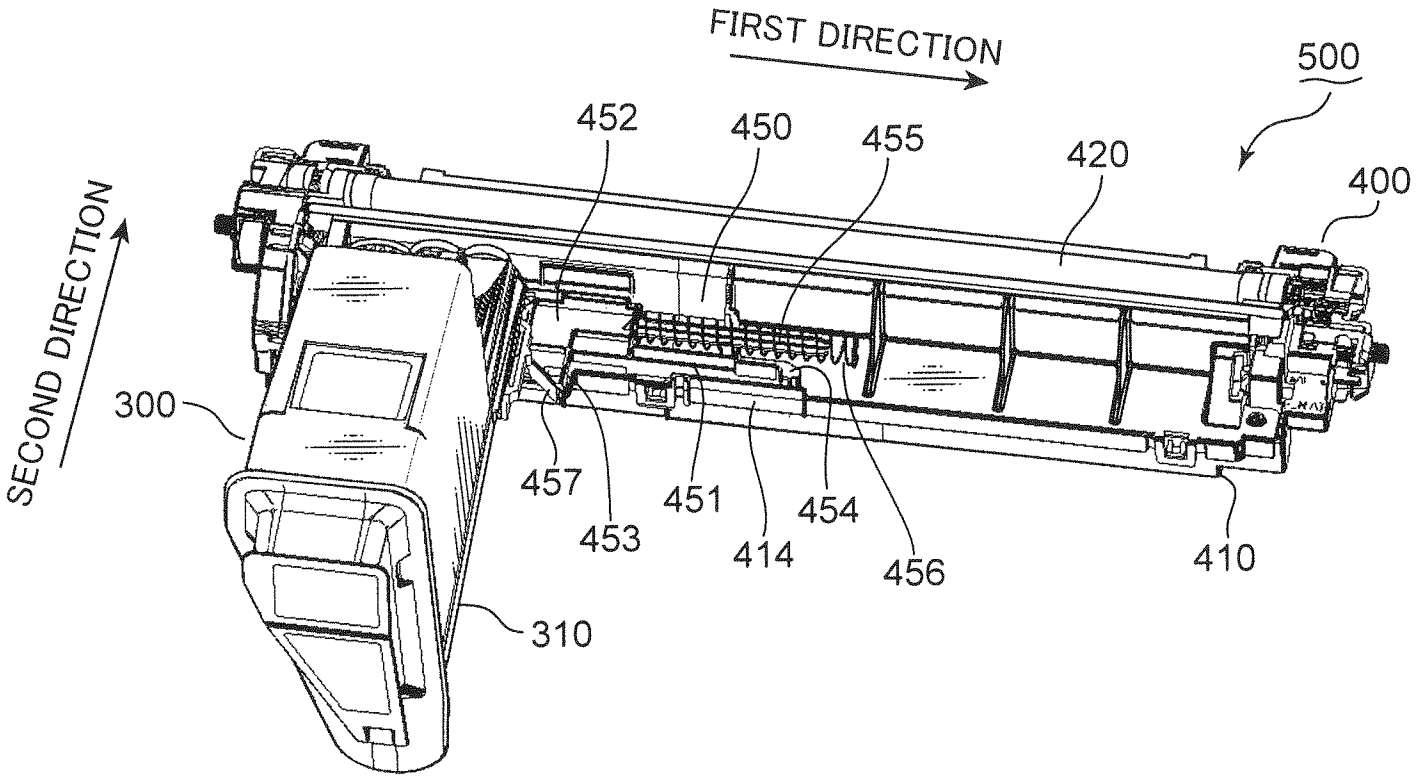
FIG. 7 is a schematic perspective view of a developing mechanism including the developing device shown in FIG. 5.

FIG. 7 is a schematic perspective view of the developing mechanism 500. The developing mechanism 500 is described with reference to FIGS. 2, 4, 5 and 7.

The developing mechanism 500 includes the container 300 and the developing device 400, as described above. When a user pushes the container 300 into the main housing 200 along the left wall 230, the container 300 is connected to the left end of the first housing 410 of the developing device 400.

As shown in FIG. 5, the first housing 410 includes a substantially flat slide surface 413 which surrounds the feed port 411 opening upward. The container 300 includes a second housing 310 defining a storage room 311 (c.f., FIG. 4) in which developer is stored. When the user pushes the container 300 into the main housing 200 along the left wall 230, the container 300 slides on the slide surface 413.

As shown in FIG. 4, the container 300 includes a conveyance screw 320 extending in the second direction. The conveyance screw 320 includes a shaft 321 extending in the second direction and a screw 322 wound around the shaft 321. When the conveyance screw 320 rotates, the developer stored in the second housing 310 is discharged towards the developing device 400.

As shown in FIG. 4, the developing device 400 is arranged near the back wall 220 of the main housing 200. On the other hand, the container 300 is arranged near the front wall 210 rather than the back wall 220. As the conveyance screw 320 discharges developer in the second direction, the developer is appropriately fed from the container 300 to the developing device 400 under an intersectional structure between the container 300 and the developing device 400.

Figure 8:
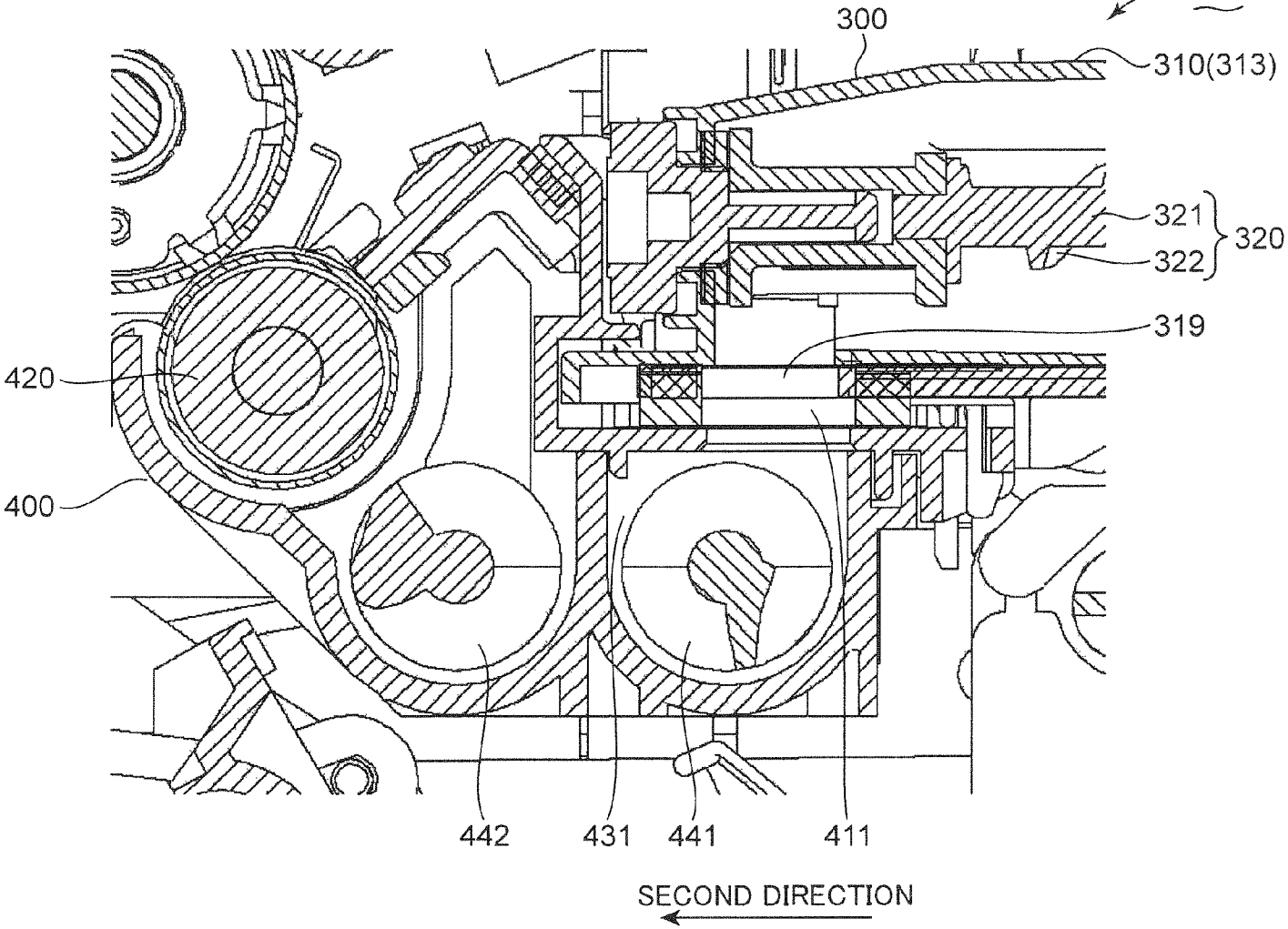
FIG. 8 is a schematic sectional view around a connecting portion between a container and the developing device shown in FIG. 5.

FIG. 8 is a schematic sectional view around a connecting portion between the container 300 and the developing device 400. The developing mechanism 500 is further described with reference to FIGS. 3 and 8.

The lower surface of the second housing 310 is provided with a supply port 319 from which developer is supplied to the developing device 400. When a user pushes the container 300 through the insertion opening 281 towards the back wall 220, the container 300 is connected to the developing device 400. In this case, the supply port 319 opening downward communicates with the feed port 411 opening upward. Consequently, developer conveyed by the conveyance screw 320 drops into the first room 431 by the action of gravity. The developer is then supplied to the developing roller 420 by means of the first and second conveyance screws 441, 442.

(First Shutter Mechanism)

Figure 9:
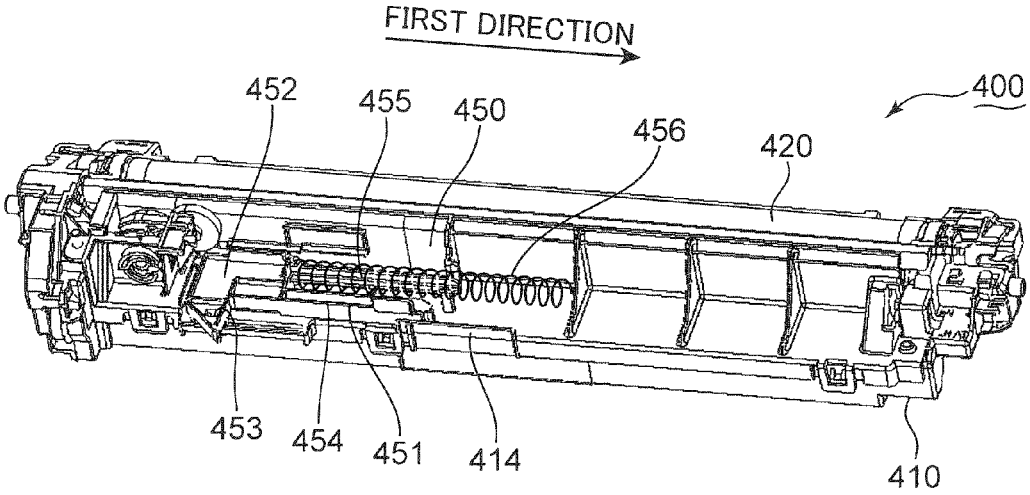
FIG. 9 is a schematic perspective view of the developing device shown in FIG. 5.
Figure 10:
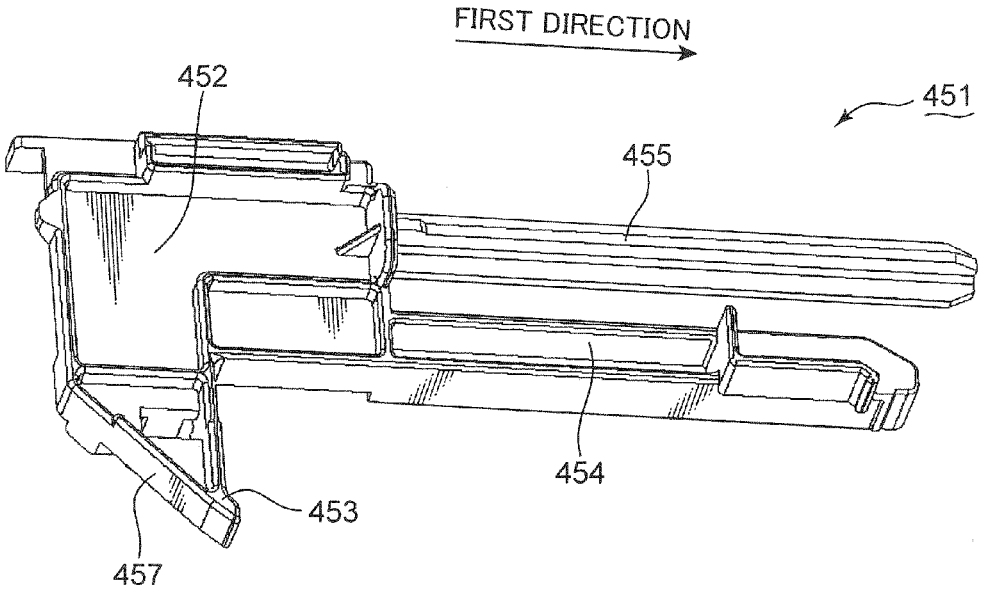
FIG. 10 is a schematic perspective view of a first shutter member configured to open and close a feed port on the developing device shown in FIG. 9.

FIG. 9 is a schematic perspective view of the developing device 400. FIG. 10 is a schematic perspective view of a first shutter member 451 which opens and closes the feed port 411. The opening and closing operations for the feed port 411 are described with reference to FIGS. 5, 7, 9 and 10.

The developing device 400 includes a first shutter mechanism 450 which selectively opens and closes the feed port 411. The first shutter mechanism 450 includes the first shutter member 451. The first shutter member 451 is displaced between a first closing position for closing the feed port 411 and a first opening position for opening the feed port 411. The first shutter member 451 shown in FIGS. 5 and 7 is in the first opening position. The first shutter member 451 shown in FIG. 9 is in the first closing position.

The first shutter member 451 includes a substantially rectangular sliding plate 452, which slides on the slide surface 413 during the displacement between the first opening and closing positions; a substantially right triangular protruding plate 453, which protrudes towards the container 300 from the sliding plate 452 of the first shutter member 451 in the first closing position; a guide nail 454, which extends from the sliding plate 452 in the first direction; and a shaft 455, which extends in the first direction between the guide nail 454 and the developing roller 420.

The first housing 410 includes a substantially rectangular guide plate 414 protruding upward. The tip of the guide nail 454 comes into contact with the guide plate 414 during displacement of the first shutter member 451 between the first opening and closing positions. Therefore, the first shutter member 451 may be stably displaced between the first opening and closing positions.

The first shutter mechanism 450 further includes a coil spring 456 wound around the shaft 455. The coil spring 456 biases the first shutter member 451 towards the first closing position. In the present embodiment, the coil spring 456 is exemplified as the biasing member. Any other elements configured to bias the first shutter member 451 towards the first closing position may be used as the biasing member.

(Container)

Figure 11:
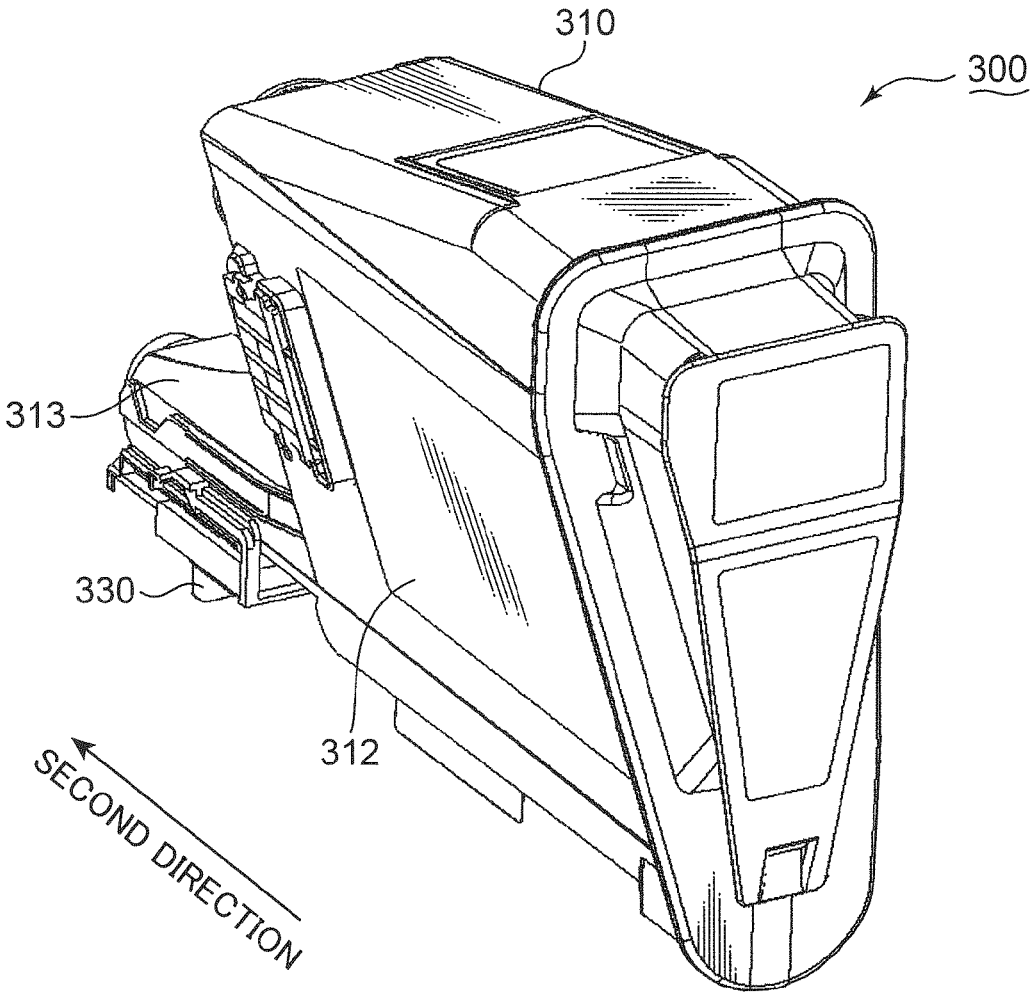
FIG. 11 is a schematic perspective view of the container of the developing mechanism shown in FIG. 7.
Figure 12:
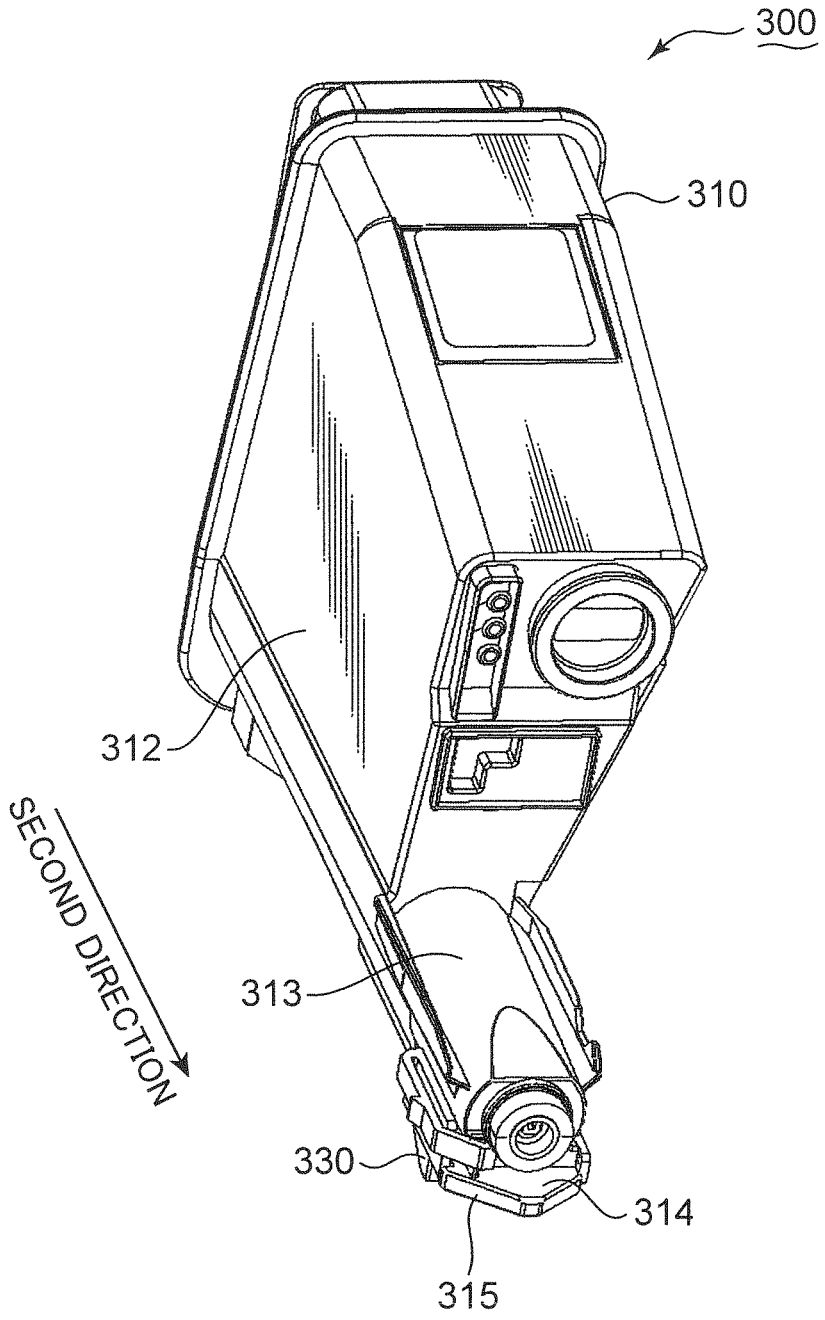
FIG. 12 is a schematic perspective view of the container of the developing mechanism shown in FIG. 7.

FIGS. 11 and 12 are schematic perspective views of the container 300. The container 300 is described with reference to FIGS. 1, 2, 7, 8, 10 to 12.

The second housing 310 of the container 300 includes a main storage portion 312 having a large capacity and a protruding cylinder 313 protruding from a lower portion of the main storage portion 312 in the second direction. A user may detach the cover panel 211 to expose the main storage portion 312 (c.f., FIGS. 1 and 2). Therefore, the user may easily attach and detach the container 300 to and from the developing device 400.

A large part of developer is stored in the main storage portion 312. As shown in FIG. 8, the conveyance screw 320 is inserted into the protruding cylinder 313. Thus, the developer is conveyed from the main storage portion 312 to the protruding cylinder 313 as rotation of the conveyance screw 320 and the action of gravity. The developer conveyed by the conveyance screw 320 in the second direction is then discharged through the supply port 319 and supplied to the developing device 400 through the feed port 411. In the present embodiment, the conveyance screw 320 is exemplified as the second conveyance member.

As shown in FIG. 12, the container 300 further includes a second shutter mechanism 330 which selectively opens and closes the supply port 319 provided at the lower surface of the protruding cylinder 313. The second shutter mechanism 330 is provided at the tip of the protruding cylinder 313.

As shown in FIG. 12, the second housing 310 includes a substantially triangular protruding tongue 314 which protrudes in the second direction. When a user inserts the container 300 in the main housing 200, the protruding tongue 314 hits the developing device 400 at first.

As shown in FIG. 10, the protruding plate 453 of the first shutter member 451 includes a sloped first contact edge 457. The protruding tongue 314 includes a sloped second contact edge 315. When a user inserts the container 300 in the main housing 200 to connect the container 300 with the developing device 400, the second contact edge 315 hits the first contact edge 457, and then the first and second contact edges 457, 315 slide on each other. Consequently, the first shutter member 451 is displaced to the first opening position (c.f., FIG. 7). By the displacement of the first shutter member 451 to the first opening position, the coil spring 456 is compressed.

(Second Shutter Mechanism)

Figure 13A:
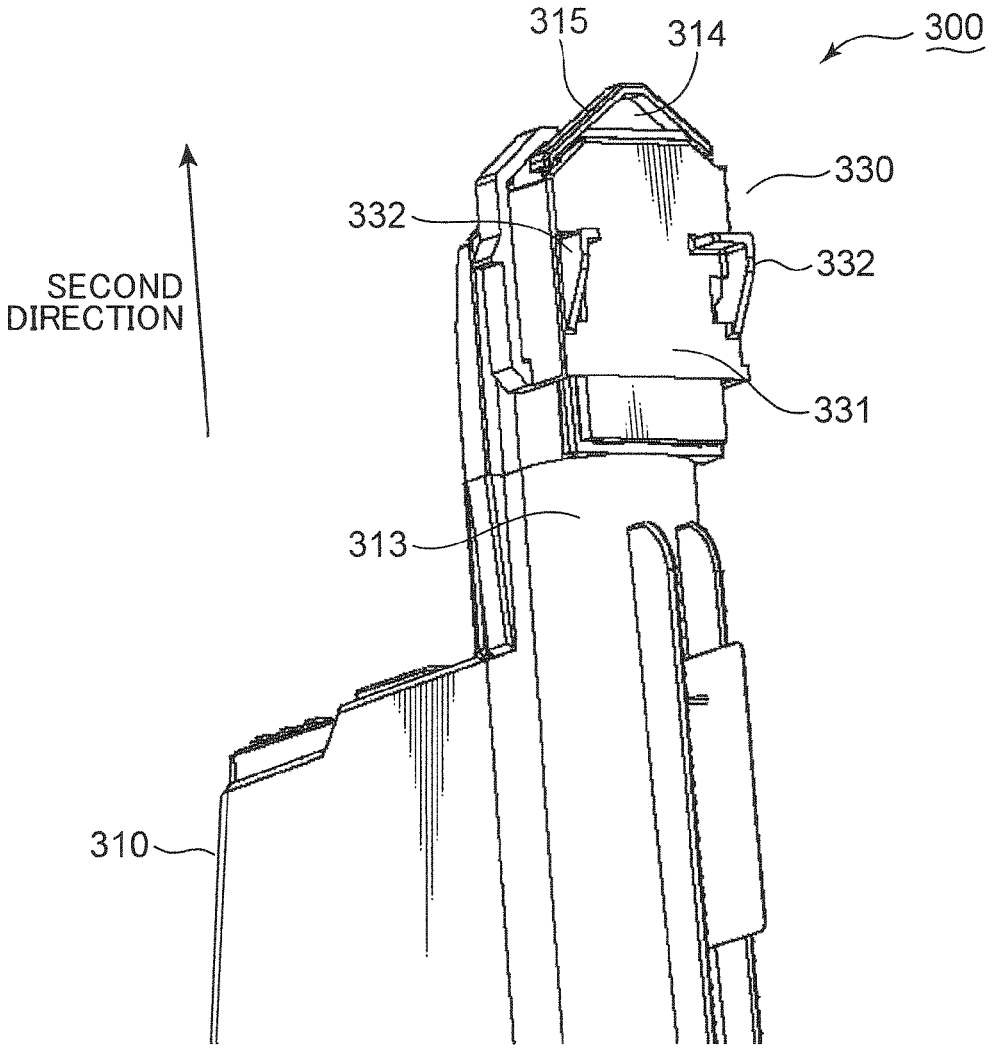
FIG. 13A is a schematic bottom perspective view of the container shown in FIG. 12.
Figure 13B:
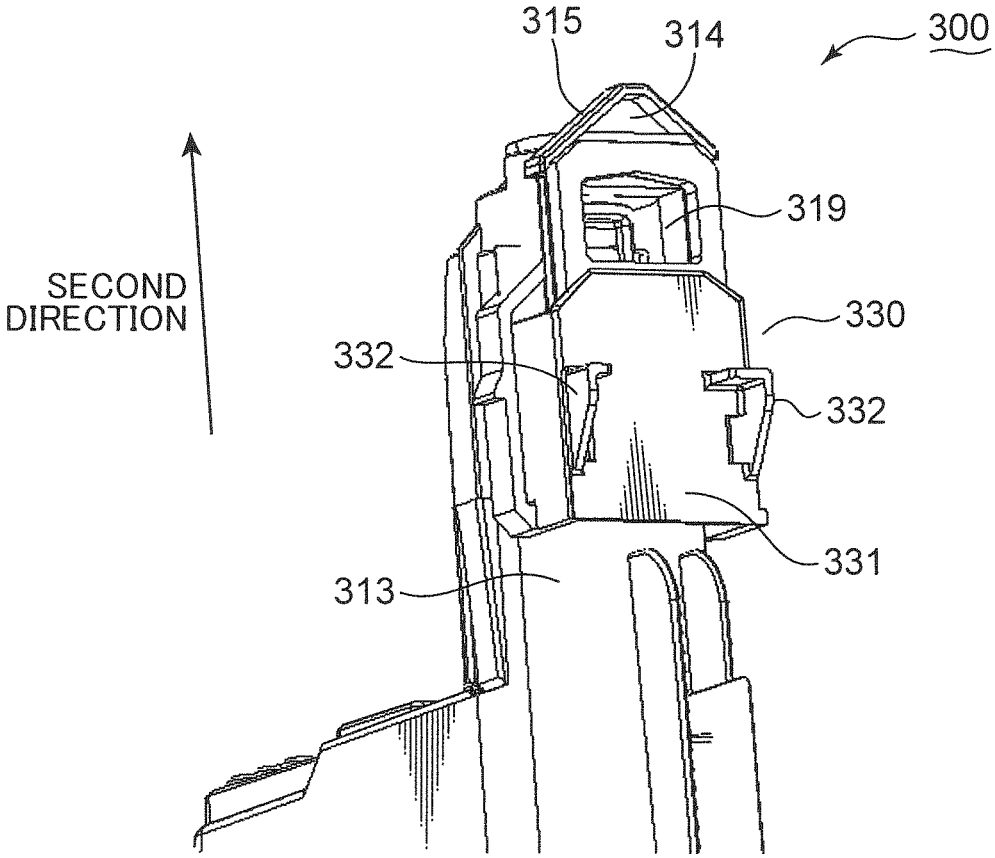
FIG. 13B is a schematic bottom perspective view of the container shown in FIG. 12.

FIGS. 13A and 13B are schematic bottom perspective views of the container 300. The second shutter mechanism 330 is described with reference to FIGS. 13A and 13B.

The second shutter mechanism 330 includes a slidable second shutter member 331, which is attached to the protruding cylinder 313 of the second housing 310, and a pair of first protrusions 332, which protrudes from the lower surface of the second shutter member 331. The second shutter member 331 is displaced along the protruding cylinder 313, which protrudes in the second direction, between a second closing position for closing the supply port 319 and a second opening position for opening the supply port 319. The second shutter member 331 in FIG. 13A is in the second closing position. The second shutter member 331 shown in FIG. 13B is in the second opening position.

Figure 14:
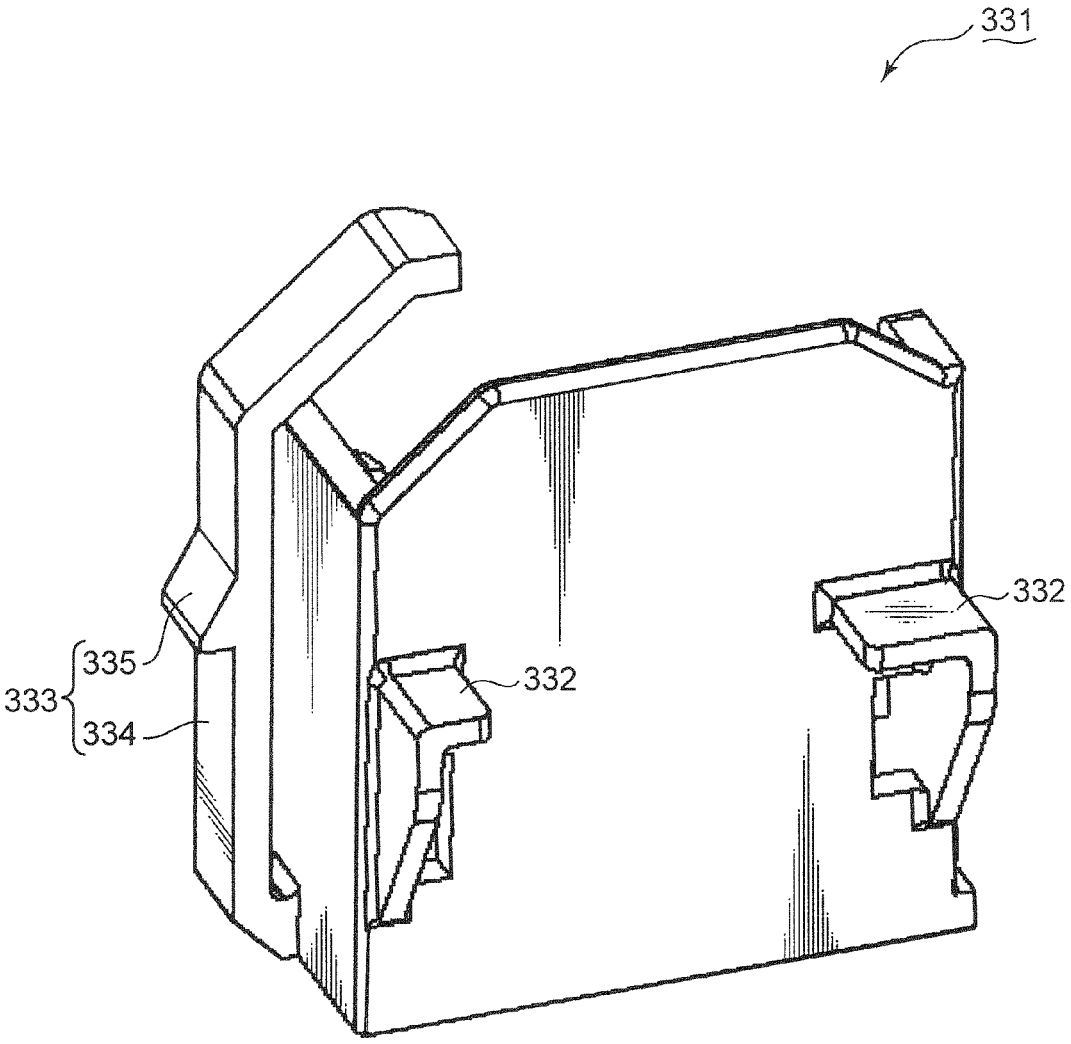
FIG. 14 is a schematic perspective view of a second shutter member of the container shown in FIG. 12.

FIG. 14 is a schematic perspective view of the second shutter member 331. The second shutter mechanism 330 is further described with reference to FIGS. 5 and 13A to 14.

As shown in FIG. 5, the slide surface 413 includes a facing edge 415, which faces the first protrusion 332. Before a user connects the container 300 with the developing device 400, the second shutter member 331 is arranged at the second closing position. When the user moves the container 300 in the second direction, the first protrusion 332 hits the facing edge 415. When the user further pushes the container 300 in the second direction, the second shutter member 331 is displaced to the second opening position. Consequently, the supply port 319 communicates with the feed port 411. In the present embodiment, the facing edge 415 is exemplified as the edge.

As described above, when the user connects the container 300 with the developing device 400, the second contact edge 315 of the protruding tongue 314 hits the first contact edge 457 of the first shutter member 451 at first. Consequently, the first shutter member 451 is displaced to the first opening position. During the displacement of the first shutter member 451 from the first closing position to the first opening position, the second shutter member 331 slides on the slide surface 413. As described above, the first protrusion 332 protruding downward from the second shutter member 331 then hits the facing edge 415, and thereafter the second shutter member 331 is displaced to the second opening position. Therefore, the feed port 411 is opened earlier than the supply port 319. Accordingly, there is little leakage of developer in the container 300 outside the developing device 400.

(Connection Process)

Figure 15A:
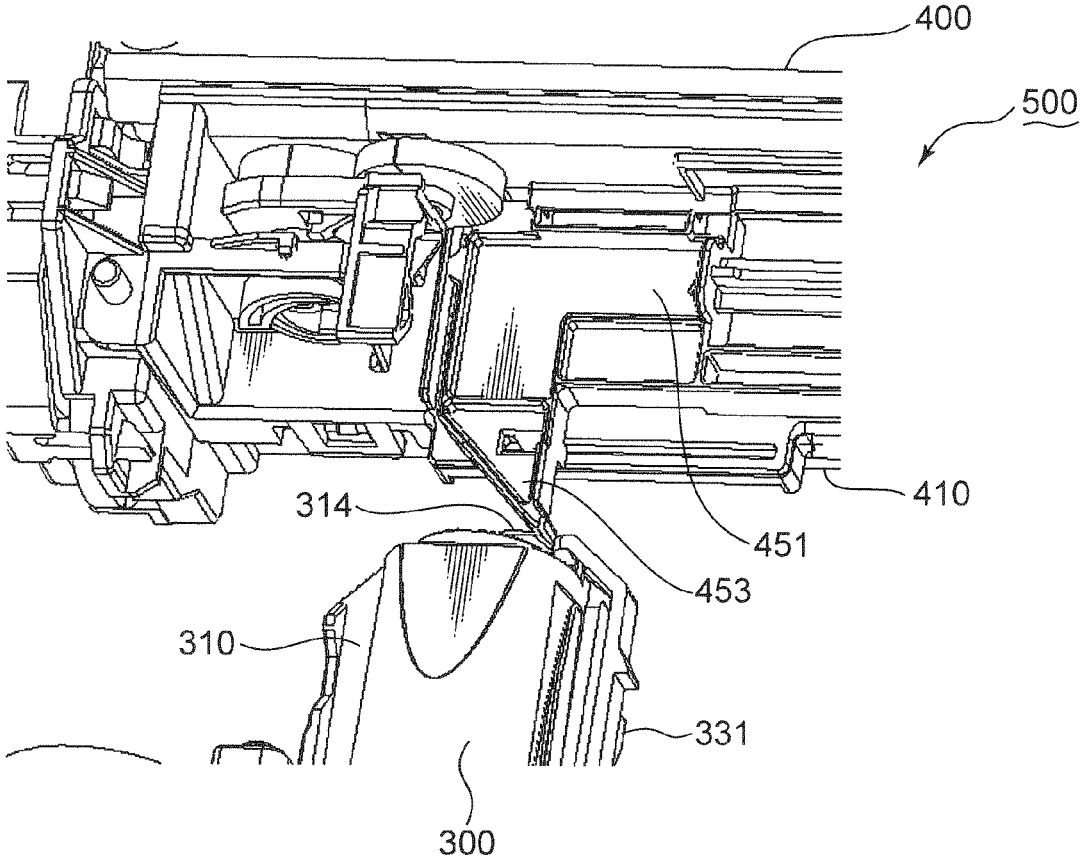
FIG. 15A is a perspective view schematically showing connection processes between the container and the developing device shown in FIG. 5.
Figure 15B:
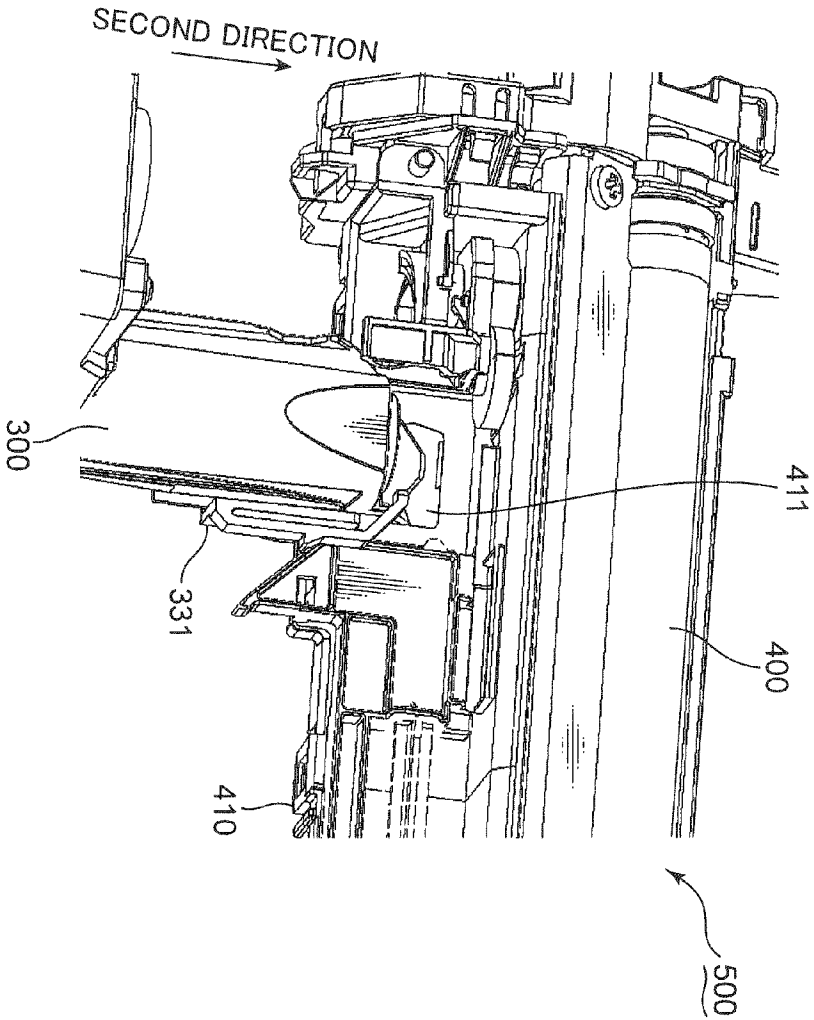
FIG. 15B is a perspective view schematically showing the connection processes between the container and the developing device shown in FIG. 5.
Figure 15C:
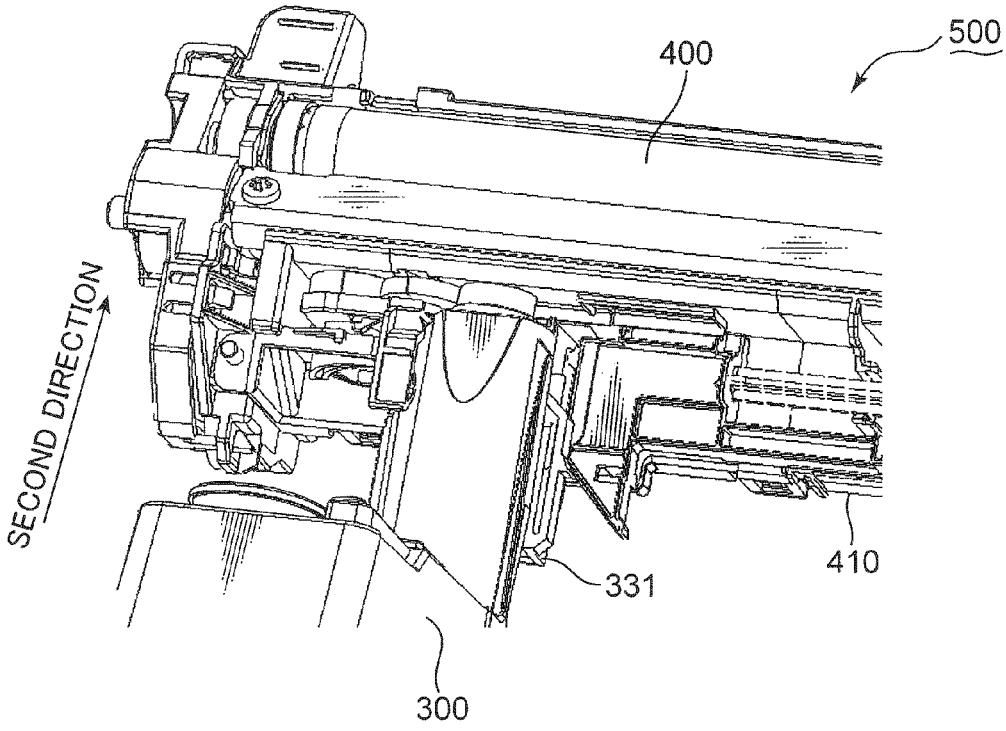
FIG. 15C is a perspective view schematically showing the connection between the container and the developing device shown in FIG. 5.

FIGS. 15A to 15C are perspective views schematically showing connection processes of the container 300 with the developing device 400. The connection processes of the developing device 400 with the container 300 are described with reference to FIGS. 5 and 14 to 15C.

In the process shown in FIG. 15A, the first shutter member 451 is in the first closing position. The second shutter member 331 is in the second closing position. The tip of the protruding tongue 314 of the second housing 310 is in contact with the tip of the protruding plate 453 of the first shutter member 451.

In the process shown in FIG. 15B, the container 300 is pushed further in the second direction from the position shown in FIG. 15A. Consequently, the first shutter member 451 is displaced to the first opening position. Accordingly, the feed port 411 is opened. The second shutter member 331 stays at the second closing position in the process shown in FIG. 15B.

In the process shown in FIG. 15C, the container 300 is pushed further in the second direction from the position shown in FIG. 15B. Consequently, the first protrusion 332 protruding from the second shutter member 331 hits the facing edge 415 of the first housing 410 so that the second shutter member 331 is displaced to the second opening position.

Figure 16A:
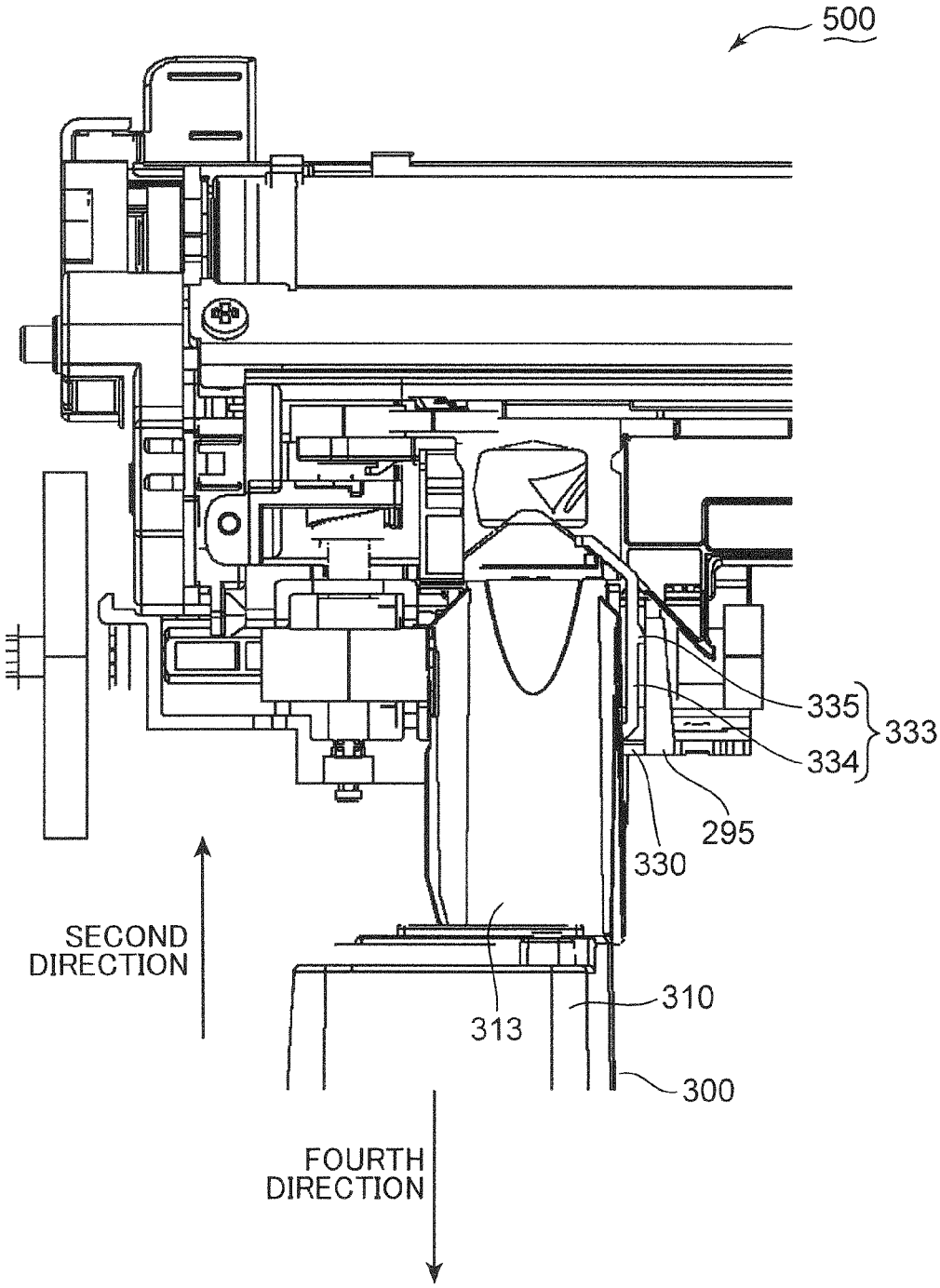
FIG. 16A is a schematic plan view corresponding to FIG. 15B.
Figure 16B:
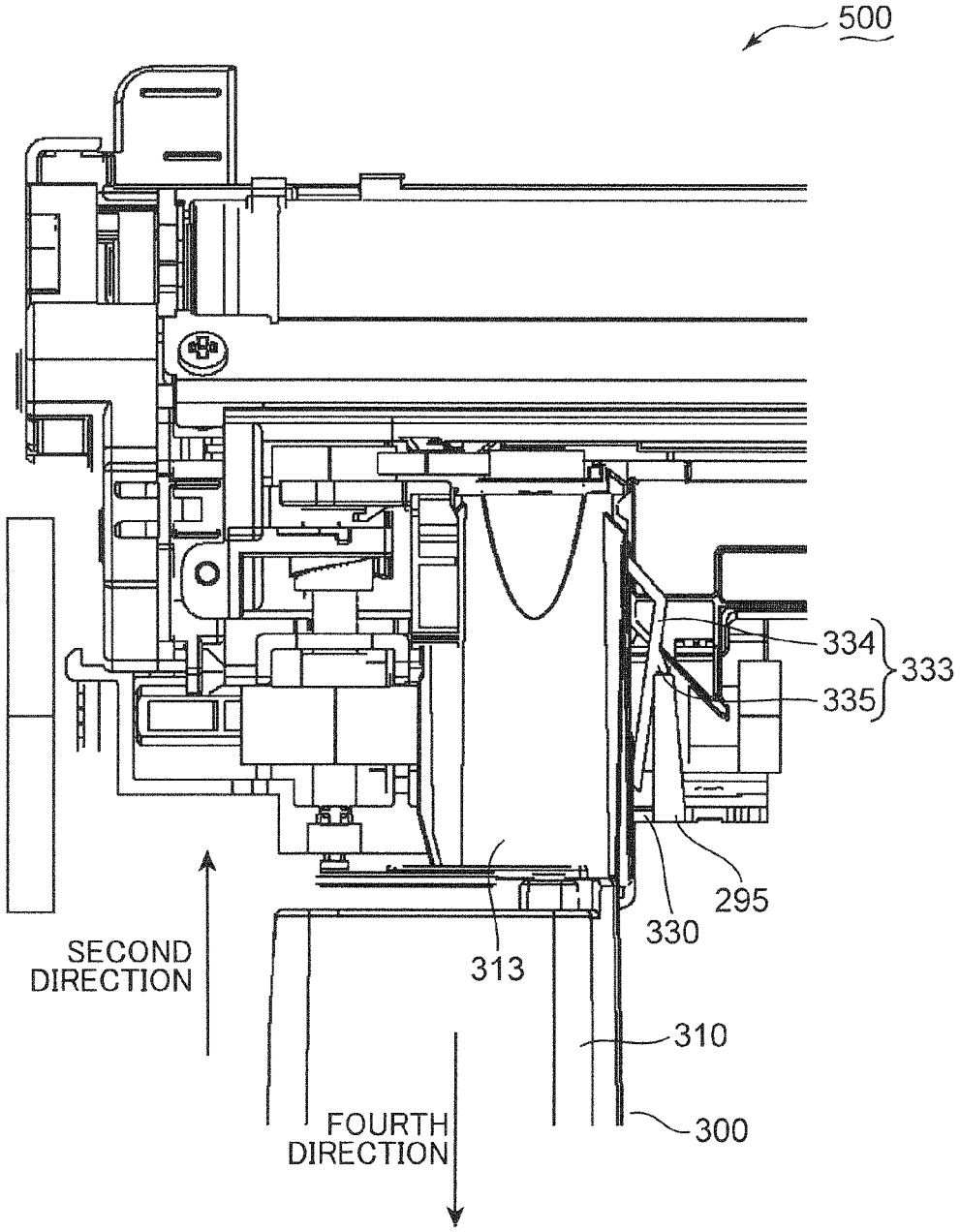
FIG. 16B is a schematic plan view corresponding to FIG. 15C.

FIG. 16A is a schematic plan view corresponding to FIG. 15B. FIG. 16B is a schematic plan view corresponding to FIG. 15C. The connection processes are further described with reference to FIGS. 3, 14, 16A and 16B.

The second shutter mechanism 330 further includes a second protrusion 333 protruding rightward from the second shutter member 331. The second protrusion 333 includes an arm 334 in a substantially J-shape and a projection 335 projecting rightward from the arm 334. As shown in FIG. 16A, while the second shutter member 331 is in the second closing position, the tip of the arm 334 is situated in front of the protruding cylinder 313 of the second housing 310 in the second direction. The second shutter member 331 moves backward with respect to the tip of the protruding cylinder 313 in the second direction when the second shutter member 331 is displaced to the second opening position. Consequently, as shown in FIG. 16B, the tip of the arm 334 hits the right surface of the protruding cylinder 313, and then is bent rightward as a whole.

The developing mechanism 500 further includes a fixed wall 295 situated on the right side of the protruding cylinder 313. The fixed wall 295 may be a part fixed in the storage room 290, which is defined by the main housing 200. In the present embodiment, the fixed wall 295 is fixed to the main housing 200 in the storage room 290. The fixed wall 295 is used as the fixed portion.

The second protrusion 333 is situated between the fixed wall 295 and the protruding cylinder 313. When the arm 334 is bent rightward due to the displacement of the second shutter member 331 to the second opening position, as shown in FIG. 16B, the projection 335 engages with an edge of the fixed wall 295. When a user then pulls out the container 300 along a fourth direction opposite to the second direction and detaches the container 300 from the developing device 400, the second shutter member 331 is displaced from the second opening position to the second closing position by the projection 335 engaged with the fixed wall 295. Therefore, there is little leakage of developer during the detachment of the container 300 from the developing device 400.

The invention claimed is:

1. A developing mechanism for development with developer in a main housing, the developing mechanism comprising:

a developing device configured to supply the developer to an electrostatic latent image and develop the electrostatic latent image; and a container configured to contain the developer and to be inserted into the main housing, wherein the developing device includes:

a carrier configured to carry and supply the developer to the electrostatic latent image;

a first housing provided with a feed port through which the developer is fed and including an edge facing the container;

a first conveyance member configured to convey the developer along a first direction away from the feed port; and a first shutter mechanism including a first shutter member configured to selectively displace between a first closing position for closing the feed port and a first opening position for opening the feed port; and the container includes:

a second housing provided with a supply port for supplying the developer through the feed port to the developing device;

a second shutter mechanism configured to selectively open and close the supply port; and a second conveyance member configured to convey the developer along a second direction across the first direction and discharge the developer through the supply port, the second shutter mechanism includes a second shutter member that is displaced between a second closing position for closing the supply port and a second opening position for opening the supply port, and a first protrusion that protrudes from the second shutter member, and the second housing includes a protruding tongue that protrudes in the second direction so as to hit and displace the first shutter ember to the first opening position before the first protrusion hits the edge, the first protrusion is configured to displace the second shutter member from the second closing position to the second opening position to make the supply port communicate with the feed port, characterized in that the protruding tongue and the first protrusion are configured to cause displacement of the second shutter member from the second closing position to the second opening position after arrival of the first shutter member at the first opening position.

2. The developing mechanism according to claim 1, wherein:

the first shutter mechanism includes:

a biasing member configured to bias the first shutter member towards the first closing position.

3. The developing mechanism according to claim 2, wherein:

the container is detachable from the developing device.

4. The developing mechanism according to claim 3, wherein:

the feed port opens upward, the supply port opens downward, and the feed port communicates with the supply port if the first shutter member moves to the first opening position while the second shutter member also moves to the second opening position.

5. The developing mechanism according to claim 4, wherein:

the first housing includes a slide surface surrounding the feed port, the second shutter member sliding on the slide surface, the slide surface includes the edge, and the first protrusion protrudes downward.

6. The developing mechanism according to claim 5 further comprising: a fixed portion fixed to the main housing, wherein:

the second shutter mechanism includes a second protrusion laterally protruding from the second shutter member, the second protrusion is engaged with the fixed portion while the second shutter member is in the second opening position, and the fixed portion moves the second shutter member from the second opening position to the second closing position when the container is detached from the developing device.

7. The developing mechanism according to claim 1, wherein the first direction is orthogonal to the second direction.

8. An image forming apparatus for forming an image comprising:

the developing mechanism according to claim 6;

an image carrier onto which the electrostatic latent image is formed; and a main housing configured to define a storage room for storing the image carrier and the developing mechanism, wherein:

the fixed portion is fixed to the main housing in the storage room.

9. An image forming apparatus for forming an image comprising:

the developing mechanism according to claim 1; and an image carrier onto which the electrostatic latent image is formed.

10. The image forming apparatus according to claim 9, wherein the main housing includes a first upright wall along the first direction and a second upright wall opposite to the first upright wall, the first upright wall is provided with an insertion opening through which the container is inserted into the main housing, the second upright wall is closer to the developing device than the first upright wall is, and the container is inserted from the insertion opening into the storage room towards the second upright wall and then connected with the developing device.

11. The image forming apparatus according to claim 10, wherein:

the main housing includes a side wall arranged between the first and second upright walls, the side wall extends along the second direction, and the container is inserted into the storage room along the side wall.

* * * * *